US011631519B2

(12) United States Patent
Lee et al.

(10) Patent No.: US 11,631,519 B2
(45) Date of Patent: Apr. 18, 2023

(54) MAGNETIC CORE

(71) Applicant: LG INNOTEK CO., LTD., Seoul (KR)

(72) Inventors: Hyun Ji Lee, Seoul (KR); Deok Hyeon Kim, Seoul (KR); Sang Won Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 221 days.

(21) Appl. No.: 16/919,546

(22) Filed: Jul. 2, 2020

(65) Prior Publication Data

US 2021/0020350 A1 Jan. 21, 2021

(30) Foreign Application Priority Data

Jul. 19, 2019 (KR) ..... 10-2019-0087300
Jun. 18, 2020 (KR) ..... 10-2020-0074176

(51) Int. Cl.
*H01F 27/255* (2006.01)
*H01F 17/04* (2006.01)
*H01F 3/08* (2006.01)

(52) U.S. Cl.
CPC ..... *H01F 27/255* (2013.01); *H01F 3/08* (2013.01); *H01F 17/04* (2013.01); *Y10T 428/32* (2015.01)

(58) Field of Classification Search
None
See application file for complete search history.

(56) References Cited

U.S. PATENT DOCUMENTS 5,518,642 A * 5/1996 Inoue ..... C04B 35/2658 252/62.62
11,289,252 B2 * 3/2022 Lee ..... H01F 17/062
2004/0130429 A1 7/2004 Watanabe et al.
2005/0236071 A1 * 10/2005 Koshiba ..... H01F 1/15308 148/304
2011/0279217 A1 * 11/2011 Yoshida ..... C04B 35/62695 336/233
2015/0022305 A1 * 1/2015 Lee ..... H01F 27/29 252/62.62
2016/0172094 A1 * 6/2016 Yeom ..... H01F 27/24 336/220
2017/0278607 A1 * 9/2017 Tada ..... H01F 1/34
2017/0352455 A1 * 12/2017 Koyuhara ..... H01F 1/36
(Continued)

FOREIGN PATENT DOCUMENTS

CN 1402266 3/2003
CN 1686931 10/2005
CN 100400462 C 7/2008
(Continued)

OTHER PUBLICATIONS

Machine Translation of JP 2015-231938 A (Year: 2015).*
(Continued)

*Primary Examiner* — Kevin M Bernatz
(74) *Attorney, Agent, or Firm* — KED & Associates, LLP

(57) ABSTRACT

Disclosed is a magnetic core having improved reliability. The magnetic core includes 37 to 44 mol % of manganese (Mn), 9 to 16 mol % of zinc (Zn), 42 to 52 mol % of iron (Fe), a magnetic additive, and a non-magnetic additive, wherein the magnetic core has a permeability of 2,900 or more and a core loss of 500 mW/cm$^3$ or less.

19 Claims, 10 Drawing Sheets

(56) References Cited

U.S. PATENT DOCUMENTS

| | | | | |
|---|---|---|---|---|
| 2019/0352872 | A1* | 11/2019 | Delden | C23F 13/20 |
| 2021/0035717 | A1* | 2/2021 | Lee | H01F 1/11 |

FOREIGN PATENT DOCUMENTS

| | | |
|---|---|---|
| CN | 101429016 | 5/2009 |
| CN | 103342554 | 10/2013 |
| CN | 103396111 | 11/2013 |
| CN | 105097169 | 11/2015 |
| EP | 1286366 | 2/2003 |
| JP | 2000-286119 | 10/2000 |
| JP | 5578766 | 8/2014 |
| KR | 10-1988-0007787 | 8/1988 |
| KR | 10-0298027 | 5/2001 |
| KR | 10-2015-0040764 | 4/2015 |
| KR | 10-2016-0022409 | 3/2016 |
| KR | 10-2017-0029462 | 3/2017 |
| KR | 10-2017-0063395 | 6/2017 |
| KR | 10-1822299 | 1/2018 |
| KR | 10-2018-0071826 | 6/2018 |
| KR | 10-1931635 | 12/2018 |
| KR | 10-2019-0093434 | 8/2019 |
| KR | 10-2020666 | 9/2019 |
| KR | 10-2020-0057315 | 5/2020 |
| WO | WO-2019151730 A1 * | 8/2019 H01F 1/017 |

OTHER PUBLICATIONS

Derwent Abstract of KR 2017-0026462 A. (Year: 2017).*

European Search Report dated Nov. 20, 2020 issued in Application No. 20185919.6.

Chinese Office Action dated Jun. 2, 2022 issued in CN Application No. 202010698415.6.

European Office Action dated Oct. 31, 2022 issued in Application 20185919.6.

Chinese Office Action dated Jan. 18, 2023 issued in CN Application No. 202010698415.6.

Soft Ferrite Manufacturing Principle and Technology dated Dec. 31, 2010.

Untitled Non-Patent Literature dated May 31, 2003.

* cited by examiner

MAGNETIC CORE

CROSS REFERENCE TO RELATED APPLICATION

This application claims priority under 35 U.S.C. § 119 to Korean Patent Application No. 10-2019-0087300, filed in Korea on Jul. 19, 2019 and No. 10-2020-0074176, filed in Korea on Jun. 18, 2020, which are hereby incorporated in its entirety by reference as if fully set forth herein.

TECHNICAL FIELD

Embodiments relate to a magnetic core having improved reliability.

BACKGROUND

In recent years, research on vehicles equipped with electric motors has been actively conducted in accordance with continued interest in, and legislation pertaining to, the environment, and the market thereof is also expanding. Therefore, the importance of the vehicle power electronics (PE) field is also increasing.

A typical vehicle power electronic component is a DC-DC converter. Vehicles using an electric motor as a power source are generally provided with a high-voltage battery for driving the electric motor in combination with an auxiliary battery for supplying power to the electric load, and the auxiliary battery can be charged through the power of the high-voltage battery. In order to charge the auxiliary battery, it is necessary to convert the DC power of the high voltage battery into DC power corresponding to the voltage of the auxiliary battery. For this purpose, a DC converter may be used.

The DC converter converts DC power into AC power, and then transforms the same through a transformer, rectifies the result again, and outputs DC power with a desired output voltage. Thus, the DC converter includes a passive element such as an inductor operating at a high frequency.

However, in general, a magnetic core constituting an inductor or transformer has a problem of the difficulty of satisfying reliability such as low-temperature characteristics or thermal shock required for a vehicle environment.

In addition, the trend toward slimming of parts has recently been applied to magnetic elements, but slimmed magnetic elements have relatively small size and surface area, which are disadvantageous from the aspects of heat capacity and heat dissipation. Thus, it is also necessary to consider a method of reducing heat generation in an attempt to reduce loss.

SUMMARY

Embodiments provide a magnetic core having improved reliability.

Further, embodiments provide a magnetic core having superior low-temperature characteristics or thermal shock characteristics.

The objects to be accomplished therein are not limited to those described above, and other objects not described herein will be obvious to those skilled in the art from the following description.

In one embodiment, a magnetic core includes 37 to 44 mol % of manganese (Mn), 9 to 16 mol % of zinc (Zn), 42 to 52 mol % of iron (Fe), a magnetic additive and a non-magnetic additive, and has a permeability of 2,900 or more and a core loss of 500 mW/cm3 or less.

For example, the magnetic core may have a permeability decrease of 4 to 9% and a core loss increase of 0.5 to 7% at −40 to 125° C. during 1,000 cycles for 30 minutes in each cycle.

For example, the magnetic core may have a permeability decrease of 2 to 5% and a core loss increase of 0.05 to 3.00% under an impact caused by an impact acceleration of a semi-sinusoidal wave of 100G in each of the ±directions in the x, y, and z axes for 6 ms.

For example, the magnetic core may have a permeability decrease of 1 to 3% and a core loss increase of 0.2 to 1.0% after vibration is maintained for 4 hours in each of the x, y and z axes at a vibration frequency of 10↔2000 Hz, a vibration acceleration of 5G for a sweep time of 20 minutes.

For example, the magnetic core may have a toroidal shape, and the magnetic core has an average breaking load of 800 N or more after applying a load at a speed of 30 mm/min 5 times under a limit load of 1,000 N vertically downwards along the height direction of the toroidal shape.

For example, the magnetic additive may include cobalt (Co) and nickel (Ni).

For example, the cobalt may be present in an amount of 0.1 to 1 mol %, and the nickel may be present in an amount of 0.1 to 0.5 mol %.

For example, the non-magnetic additive may include at least one of silicon (Si), calcium (Ca), tantalum (Ta), vanadium (V) or zirconium (Zr).

For example, the silicon may be present in an amount of 50 to 200 ppm, the calcium may be present in an amount of 200 to 700 ppm, the tantalum may be present in an amount of 200 to 900 ppm, the vanadium may be present in an amount of 50 to 500 ppm, and the zirconium may be present in an amount of 50 to 500 ppm.

In another embodiment, a magnetic core includes a magnetic compound containing 37 to 44 mol % of manganese (Mn), 9 to 16 mol % of zinc (Zn), 42 to 52 mol % of iron (Fe), 0.1 to 1 mol % of cobalt (Co), 0.1 to 0.5 mol % of nickel (Ni) and an additive, wherein the magnetic compound includes a plurality of grains and a grain boundary between the corresponding grains, wherein the ratio of the content of the cobalt at the center of a first grain among the plurality of grains to the content of the cobalt at the center of a first grain boundary, located between the first grain and a second grain adjacent thereto, may be 0.4 or more.

For example, the content of cobalt may gradually decrease from the first grain to the first grain boundary.

For example, the ratio of the content of cobalt at the center of a third grain among the plurality of grains to the content of cobalt at the center of a second grain boundary, located between the third grain and a fourth grain adjacent thereto, may be 0.4 or more.

For example, the additive may include a nonmagnetic material.

For example, the nonmagnetic material may include at least four of silicon (Si), calcium (Ca), tantalum (Ta), vanadium (V), niobium (Nb), or zirconium (Zr).

For example, the silicon may be present in an amount of 50 to 200 ppm, the calcium may be present in an amount of 200 to 700 ppm, the tantalum may be present in an amount of 200 to 900 ppm, the vanadium may be present in an amount of 50 to 500 ppm, and the zirconium may be present in an amount of 50 to 500 ppm.

In another embodiment, a magnetic core includes a magnetic compound containing 37 to 44 mol % of manganese (Mn), 9 to 16 mol % of zinc (Zn), 42 to 52 mol % of iron (Fe) and a non-magnetic additive, wherein the non-magnetic additive includes 50 to 200 ppm of $SiO_2$, 200 to 700 ppm of CaO, 200 to 900 ppm of $Ta_2O_5$, 50 to 500 ppm of $ZrO_2$, and 50 to 500 ppm of $V_2O_5$, wherein the magnetic compound includes a plurality of grains and a grain boundary between the corresponding grains, wherein the content of at least one of the non-magnetic additive gradually increases in a first direction from the center of the first grain to the second grain adjacent to the first grain, and the ratio of the total content of at least one of the non-magnetic additive in the first grain to the total content of at least one of the non-magnetic additive in the first grain boundary between the first grain and the second grain may be 0.1 or more.

For example, the magnetic core may further include a magnetic additive of at least one of cobalt (Co) or nickel (Ni).

For example, the cobalt may be present in an amount of 0.1 to 1 mol %, and the nickel may be present in an amount of 0.1 to 0.5 mol %.

For example, the ratio of the content of cobalt at the center of the first grain to the content of cobalt at the center of the first grain boundary may be 0.4 or more.

For example, the ratio of the content of nickel at the center of the first grain to the content of nickel at the center of the first grain boundary may be 0.4 or more.

In another embodiment, a magnetic core includes a compound containing 37 to 44 mol % of manganese (Mn), 9 to 16 mol % of zinc (Zn), 42 to 52 mol % of iron (Fe) and an additive, wherein the additive includes at least three elements in Groups 4 and 5 of the periodic table.

For example, the element in Group 5 may include at least two of tantalum (Ta), vanadium (V), or niobium (Nb).

For example, the element in Group 4 may include at least one of zirconium (Zr) or titanium (Ti).

For example, the total content of elements in Groups 4 and 5 may be 1,500 ppm or less.

For example, the additive may further include at least three of cobalt (Co), nickel (Ni), silicon (Si), or calcium (Ca).

For example, the additive may include oxide.

For example, the additive may include 50 to 200 ppm of $SiO_2$, 200 to 700 ppm of CaO, 200 to 900 ppm of $Ta_2O_5$, 50 to 500 ppm of $ZrO_2$, and 50 to 500 ppm of $V_2O_5$.

For example, the magnetic compound includes a plurality of grains and a grain boundary between the corresponding grains, wherein the compound includes at least one non-magnetic material and the content of the at least one non-magnetic additive gradually increases in a first direction from the center of the first grain to a second grain adjacent to the first grain, and the ratio of the total content of the at least one non-magnetic additive in the first grain to the total content of the at least one non-magnetic additive in the first grain boundary between the first grain and the second grain may be 0.1 or more.

BRIEF DESCRIPTION OF THE DRAWINGS

Arrangements and embodiments may be described in detail with reference to the following drawings, in which like reference numerals refer to like elements, and wherein.

DESCRIPTION OF SPECIFIC EMBODIMENTS

Figure 1:
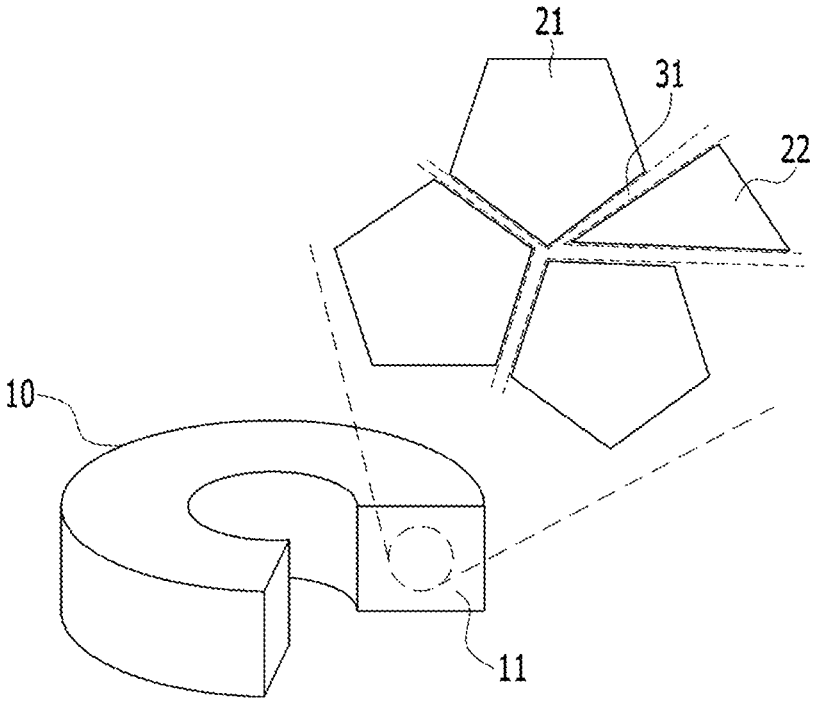
FIG. 1 shows an example of the bonding form of a material constituting a magnetic core according to an embodiment.

It should be understood that numerous other modifications and embodiments will fall within the spirit and scope of the principles of this disclosure, and certain embodiments will be exemplified and described with reference to the attached drawings. However, it should be construed that these embodiments do not limit the scope of this disclosure and include all possible variations, equivalents and substitutions which fall within the scope of this disclosure.

It will be understood that, although terms including ordinal numbers such as "second" or "first" may be used herein to describe various elements, these elements should not be construed as being limited by these terms which are used only to distinguish one element from another. For example, within the scope defined by the disclosure, a second element may be referred to as a first element, and similarly, a first element may be referred to as a second element. The term "and/or" includes a combination of a plurality of the related described items or any one of the plurality of related described items.

It will be understood that when an element is referred to as being "bound" or "connected" to another element, it may be directly bound or connected to the element, or one or more intervening elements may also be present therebetween. On the other hand, it will be understood that when an element is referred to as being "directly bound" or "directly connected" to another element, there is no intervening element therebetween.

It will be understood that when an element such as a layer (film), region, pattern or structure is referred to as being "on" or "under" another element such as a substrate, each layer (film), region, pad or pattern, it may be directly on/under the element, or one or more intervening elements may also be present. When an element is referred to as being "on" or "under", "under the element" as well as "on the element" can be included based on the element. In addition, in the drawings, the thickness or size of a layer (film), region, pattern or structure may be exaggerated for clarity and convenience, and may thus be different from the actual thickness or size thereof.

In addition, terms herein used are provided only for illustration of certain embodiments and should not be construed as limiting the scope of the disclosure. Singular forms are intended to include plural forms as well, unless the context clearly indicates otherwise. It will be further understood that the terms "comprises" and/or "has" herein used specify the presence of stated features, numbers, steps, operations, elements, components or combinations thereof, but do not preclude the presence or addition of one or more other features, numbers, steps, operations, elements, components, or combinations thereof.

Unless differently defined, all terms used herein including technical or scientific terms have the same meanings as generally understood by those skilled in the art. In addition, terms identical to those defined in generally used dictionaries should be interpreted as having meanings identical to contextual meanings in the related art, and are not to be interpreted as having abnormally or excessively formal meanings unless they are definitely defined herein.

According to one embodiment, the proportion of a specific metal element at a grain boundary can be increased so that the magnetic core can exhibit better reliability.

FIG. 1 shows an example of the bonding form of a material constituting a magnetic core according to an embodiment. FIG. 1 shows an enlarged shape of one end surface 11 of a toroidal magnetic core 10.

Referring to FIG. 1, the material constituting the magnetic core 10 according to the embodiment includes solid portions 21 and 22 grown from crystal nuclei, that is, grains, and a grain boundary corresponding to the boundary 31 between the corresponding grains 21 and 22. In a general core, the content of the main composition material in the grain boundary 31 is low, and the content of the main composition material in the grains 21 and 22 is relatively high. However, excellent reliability can be imparted to the magnetic core according to the present embodiment by increasing the content ratio of the main composition material in at least a part of the grain boundary 31.

For this purpose, unlike a general core-manufacturing process, in which an additive is mixed with the main composition material at an initial stage, in this embodiment, at least a part of additives may be mixed after mixing of the main composition materials and then calcination.

Hereinafter, the main composition materials and additives according to the present embodiment will be first described and then the manufacturing process will be described.

The main composition of the magnetic core according to an embodiment may have the content ratio shown in Table 1 below.

TABLE 1

| Main composition | Content (mol %) |
|---|---|
| Mn (Group 7) | 37~44 |
| Zn (Group 12) | 9~16 |
| Fe (Group 7) | 42~52 |
| CoO (Group 9) | 0.1~1 |
| NiO (Group 10) | 0.1~0.5 |

Referring to Table 1, the magnetic core according to an embodiment includes manganese (Mn), zinc (Zn) and iron (Fe) as main composition materials, and includes cobalt oxide (CoO) and nickel oxide (NiO) as magnetic additives. The content ratio of Table 1 is based on a molar ratio (mol %), and the results of experimentation of combination properties based on weight ratio (wt %) are shown in Table 2 below.

TABLE 2

| Sample | Content wt (%) | | | | |
|---|---|---|---|---|---|
| No. | Fe | Mn | Zn | Permeability | Loss |
| 1 | 71 | 11.97 | 17.03 | 1951 | 1800 |
| 2 | 71.19 | 16 | 12.81 | 1687 | 1923 |
| 3 | 71.38 | 20.06 | 8.56 | 2291 | 1370 |
| 4 | 71.58 | 22.13 | 6.29 | 2093 | 1349 |
| 5 | 67.13 | 20.04 | 12.83 | 1005 | 2877 |
| 6 | 67.31 | 24.11 | 8.58 | 648 | 2301 |
| 7 | 67.49 | 28.21 | 4.3 | 460 | 3280 |
| 8 | 67.68 | 32.32 | 0 | 139 | 6225 |

Table 2 shows the results of experiments in which the content of Fe is fixed to about 71% in Samples 1 to 4 and about 67% in samples 5 to 8, respectively, under the same sintering conditions, excluding additives to be described later.

First, in the case of Samples 1 to 4, the composition is changed by decreasing the Zn content while increasing the Mn content from Sample 1 to Sample 4, and Sample 3 is determined to be optimal from the aspect of loss. That is, the performance is improved when the content of Mn is 20 wt % or more and the content of Zn is 8.56 wt % or less.

In addition, in the case of Samples 5 to 8, the composition is changed by decreasing the Zn content while increasing the Mn content from Sample 5 to Sample 8. Performance with respect to loss is excellent when the content of Zn is 4.3 to 12.83 wt %, and Sample 6, having a Zn content of 8.56% is determined to be optimal from the aspect of loss. The Zn ratio is excessively reduced when the content of Mn is 28.2 wt % or more, thus causing deterioration in performance.

TABLE 3

| | $Fe_2O_3$ | $Mn_3O_4$ | ZnO | $Co_3O_4$ | NiO | Permeability | Loss |
|---|---|---|---|---|---|---|---|
| 1 | 70.46 | 23.59 | 5.61 | 0.3 | 0.04 | 804 | 3009 |
| 2 | 70.13 | 23.88 | 5.65 | 0.3 | 0.04 | 882 | 2785 |
| 3 | 70.11 | 23.33 | 6.22 | 0.3 | 0.04 | 1028 | 2041 |
| 4 | 70.02 | 21.86 | 7.79 | 0.3 | 0.04 | 1057 | 2263 |
| 5 | 69.71 | 22.09 | 7.86 | 0.3 | 0.04 | 991 | 2380 |
| 6 | 69.99 | 20.79 | 8.88 | 0.3 | 0.04 | 1038 | 2191 |
| 7 | 69.66 | 21.02 | 8.98 | 0.3 | 0.04 | 1055 | 2398 |

In conclusion, when Fe2O3 is present in an amount of about 70 wt %, as shown in Table 3 above, the optimal content of Zn is 6 wt % or more in consideration of loss.

Next, the non-magnetic additives will be described with reference to Table 4 below.

TABLE 4

| Type of additive | Content(ppm) |
|---|---|
| $SiO_2$ (Group 14) | 50~200 |
| CaO (Group 2) | 200~700 |
| $Ta_2O_5$ (Group 5) | 200~900 |
| $ZrO_2$ (Group 5) | 50~500 |
| $V_2O_5$ (Group 5) | 50~500 |

As can be seen from Table 4, in addition to the above-described main composition materials, the magnetic core according to the embodiment includes at least one of non-magnetic additives including silicon oxide (SiO2), calcium oxide (CaO), tantalum pentoxide (Ta2O5), zirconium dioxide (ZrO2) and vanadium pentoxide (V2O5). Such a non-magnetic additive may serve to maintain bonding strength between main components after heat treatment (that is, sintering) to be described later.

A method for manufacturing a magnetic core using respective materials shown in Tables 1 to 4 according to an embodiment will be described with reference to FIG. 2.

Figure 2:
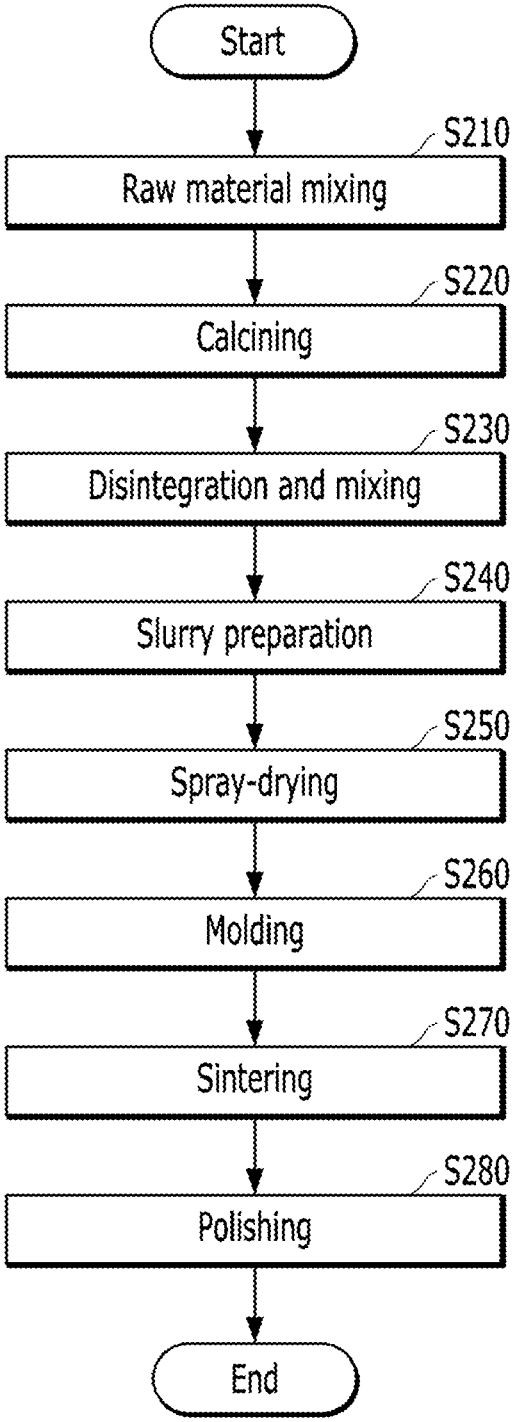
FIG. 2 is a flow chart showing an example of a process of manufacturing a magnetic core according to an embodiment.

FIG. 2 is a flow chart showing an example of a process of manufacturing a magnetic core according to an embodiment.

Referring to FIG. 2, first, Fe2O3, MnO, ZnO, CoO, and NiO powders, prepared as raw materials (i.e., main composition materials or main components), may be mixed with one another (S210). Here, the purity of each raw material may be 99% or more, and the particle size of the powder may be 10 μm or less, but the disclosure is not limited thereto. For example, this process may be carried out using use a ball mill, the amount of balls may be 2.5 times the weight of the raw material, and the process may be performed at 24 rpm for 18 hours.

Next, the mixed raw material powder may be calcined to increase the density of the spherical grains (S220) in a spray-drying (S250) process, which will be described later. For example, the process may be performed by elevating the temperature to a maximum of 950° C. at a heating rate of 3.5° C./min and maintaining the temperature for 4 hours, but the disclosure is not limited thereto.

Next, in general, since the calcined powder particles are often aggregated (entangled) with one another, a disintegration process to minimize the particle size may be performed (S230). At this time, components other than the raw material, that is, non-magnetic additives such as SiO, CaO, Ta2O5, ZrO2 and V2O5, may be mixed in this process. The process may also be carried out using a ball mill, but the disclosure is not limited thereto.

Next, slurry to be sprayed in the spray-drying (S250) process described below may be prepared (S240). This process may be performed by stirring a solvent, a binder, and a binder dispersant along with the resulting product of S230. For example, the solvent may be distilled water, the binder may be polyvinyl alcohol present in an amount of 1 wt % of the result of S230, and the binder dispersant may be present in an amount of 0.1 to 0.3 wt % of the resulting product of S230. The stirring time may be 10 hours or more, but the disclosure is not necessarily limited thereto.

The prepared slurry may be granulated in a spherical shape through the spray-drying process (S250). This process improves the flowability of the powder through granulation of particles, thereby enabling high-pressure molding in the subsequent molding step (S260). This is because, as the pressure increases during molding, the density of the resulting product increases and magnetic properties are thus improved.

The spray-dried granulated particles may be molded into a desired shape at a high pressure (S260). For example, the desired shape includes a toroidal type, an E type, an EPC type, an I type or the like, depending on the application, and the pressure may be 3 to 5 tons/unit area, but the disclosure is not limited thereto.

When the molding is completed, a sintering process for securing desired core performance may be performed (S270). For example, the process may be performed by maintaining a maximum temperature of 1,360° C. for 4 hours, but the disclosure is not limited thereto.

After sintering, a surface-polishing process for component application may be performed (S280).

The process described so far has the greatest difference from a general process in terms of the time of mixing of the non-magnetic additives rather than the main components. In other words, in the general process, the main components and the non-magnetic additives are initially mixed together, whereas, in the process according to the present embodiment, the non-magnetic additives may be mixed and incorporated after mixing, calcining and disintegration of the raw materials. The process according to this embodiment may be referred to as a "post-addition process".

Further, according to another embodiment, the post-addition process may be performed in two steps. For example, as described above, after mixing, calcining and disintegration of the raw materials, 92% to 96% of the nonmagnetic additive is added, and the remaining amount of nonmagnetic additive (i.e., 4% to 8% of the previously added amount) is added during the spray drying (S250). In this case, a higher amount of additives may be distributed at the grain boundary.

The effect of the post-addition process will be described with reference to FIG. 3 and Table 5.

Figure 3:
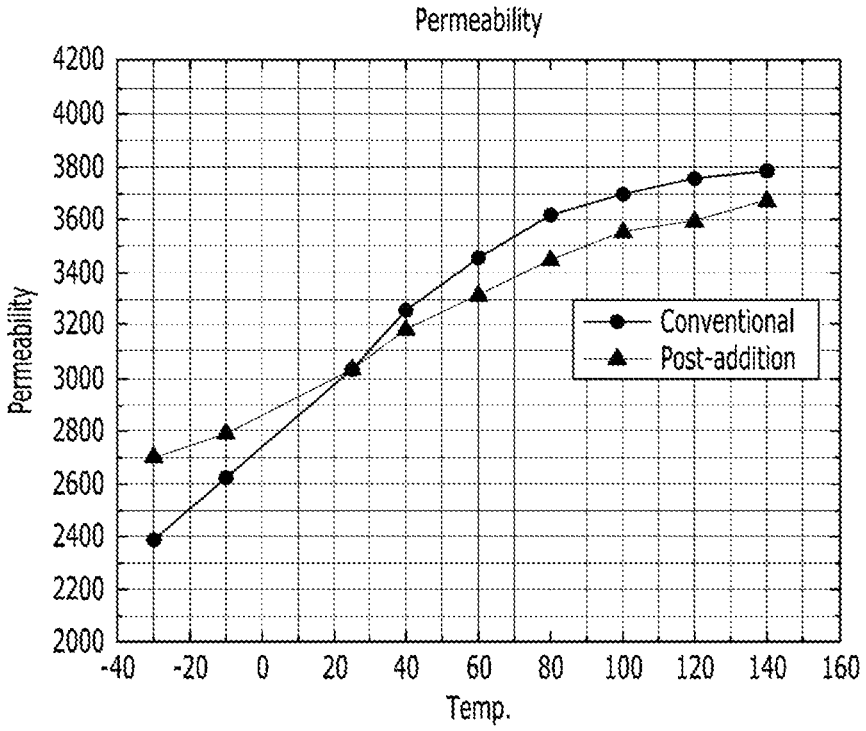
FIG. 3 illustrates the effect of a post-addition process according to the embodiment.
Figure 3:
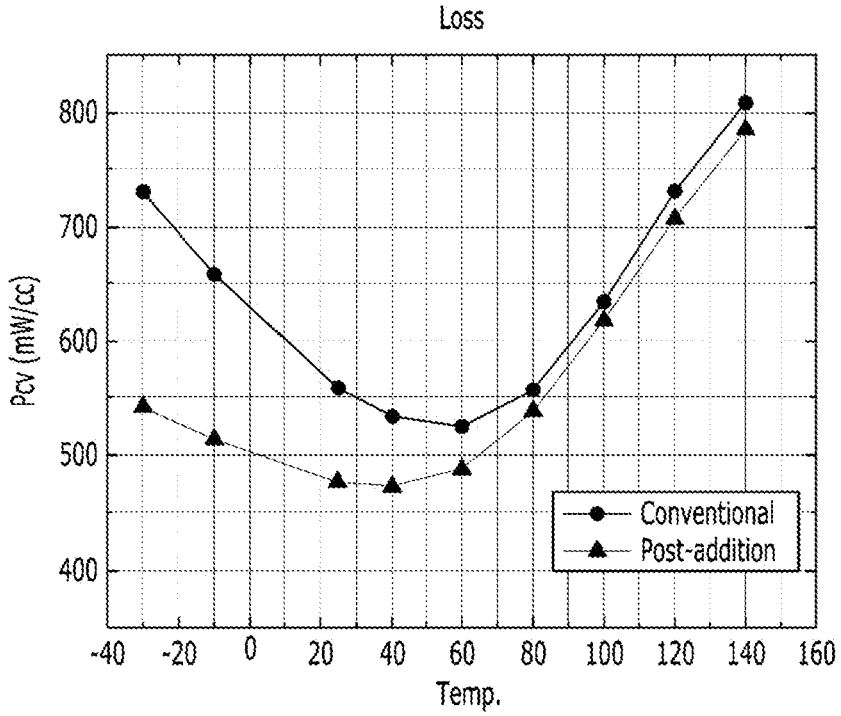

FIG. 3 illustrates the effect of the post-addition process according to the embodiment.

In FIG. 3, the permeability and loss at each temperature are shown when the post-addition process of the embodiment is applied and when a general process (referred to as an "conventional process") is applied.

The sintering conditions and the main composition ratio (i.e., Fe 69.75 wt %, Mn 22.94 wt %, Zn 6.97 wt %), and additive contents (Si 100 ppm, Ca 500 ppm, Ta 500 ppm, Zr 100 ppm, V 100 ppm, Co 2,000 ppm, Ni 200 ppm) are fixed in both the post-addition process and the conventional process. However, in the post-addition process, Co and Ni, added after mixing, calcining and disintegration of the raw materials, account for 10% of the amount of the corresponding additive.

The loss and permeability at 25° C. and −30° C., shown in FIG. 3, are shown in Table 5 below.

TABLE 5

| Characteristics | Conventional process | Post-addition process |
|---|---|---|
| 25° C. loss | 558 | 477 |
| 25° C. permeability | 3,034 | 3,037 |
| −30° C. loss | 730 | 543 |
| −30° C. permeability | 2,389 | 2,702 |

As can be seen from FIG. 3 and Table 5, both loss and permeability at a low temperature (here, −30° C.) are improved, that is, low-temperature characteristics are improved, especially when a post-addition process is applied, compared to the conventional process.

Meanwhile, the function of each component in the described process is as follows.

First, SiO2 can cause excessive grain growth by inducing flow through the grain boundary when SiO2 is present in an amount of 200 ppm or more.

Non-magnetic additives (such as SiO2, CaO, Ta2O5, Nb2O5 and ZrO2) can commonly contribute to reducing hysteresis loss. For example, Ta2O5 can help CaO to be distributed well at grain boundaries. Here, Ta2O5 may be replaced with Nb2O5 or ZrO2 (i.e., (SiO2+CaO)+(Ta2O5, Nb2O5, ZrO2)).

In addition, non-magnetic additives also contribute to reducing eddy current loss. Specifically, since there is a high possibility that CaO is present at the grain boundary, it precipitates on the grain boundary, thus increasing the resistivity of the grain boundary. In addition, V2O5 can form a liquid film on the grain boundary, thereby suppressing grain growth. In addition, Ta2O5 can function to suppress excessive grain growth due to the increase in specific resistance and addition of SiO2.

Meanwhile, Co enables Fe2+ to be substituted with Co2+ to improve the temperature dependence of permeability, thereby contributing to the control of anisotropy.

In addition, NiO, which replaces ZnO, can increase the relative content of Fe2O3, thereby shifting a core loss minimum expression temperature to a high temperature.

In addition, CaO, which is present at the grain boundary, has effects of reducing hysteresis loss, as described above, and of improving high-frequency response.

Figure 4:
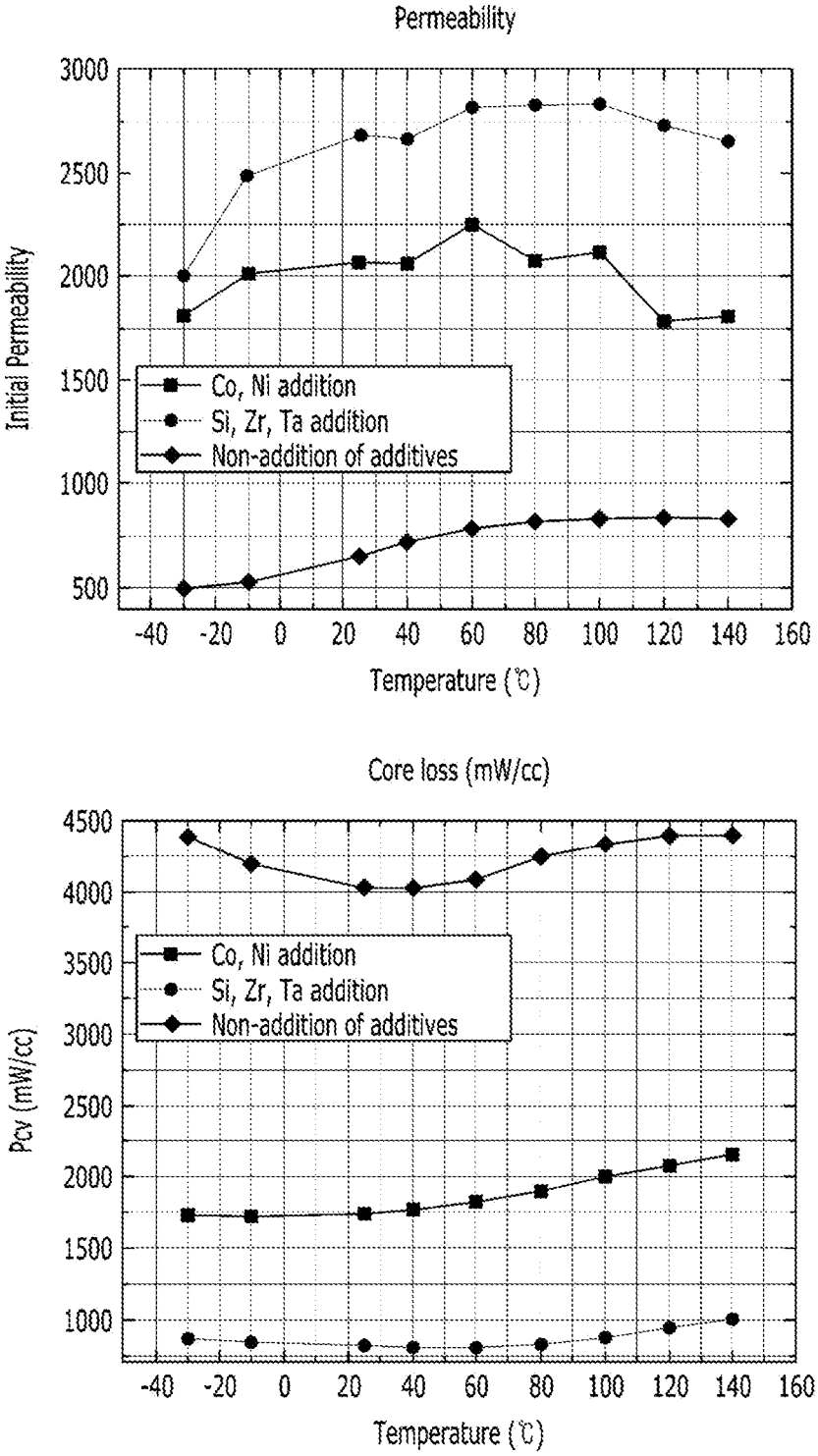
FIG. 4 illustrates the effect of additives according to the embodiment.

The effects of the addition of additives such as Si, Zr and Ta described above will be described with reference to FIG. 4 and Table 6. FIG. 4 illustrates the effect of the additives according to the embodiment.

In FIG. 4, in order to more clearly elucidate the effect of addition of the additives, a general process (that is, addition of main components and non-magnetic additives during initial mixing) was applied, rather than the described post-addition (in which non-magnetic additives are mixed after mixing, calcination and disintegration of raw materials). The main components and non-magnetic additives were mixed together, and the sintering process and the main composition ratio (that is, Fe 70.7 wt %, Mn 23.17 wt %, Zn 6.13 wt %) were fixed in each situation.

Referring to FIG. 4, the experiment was performed under three sets of conditions: i) when no additives were added, ii) when Co and Ni were added, and iii) when Si, Zr, and Ta were added along with Co and Ni.

The loss and permeability at 25° C. in FIG. 4 are shown in Table 6 below.

TABLE 6

| Characteristics | Non-addition of additive | Addition of Co, Ni | Addition of Si, Zr, Ta |
|---|---|---|---|
| 25° C. loss | 4,034 | 1,741 | 827 |
| 25° C. Permeability | 652 | 2,063 | 2,682 |

As can be seen from FIG. 4 and Table 6, when Si, Zr, and Ta were added along with Co and Ni, the best performance with regard to both permeability and loss was obtained.

Hereinafter, the optimal content of the components according to an embodiment will be described.

First, the experimental conditions related to the content of Ni are as follows.

The content of Ni was changed to 200 ppm, 400 ppm and 600 ppm, but the sintering process was the same in each case, and the main components were fixed at Fe of 71.13 wt %, Mn of 21.76 wt % and Zn of 7.11 wt %, and the additives were fixed at 3000 ppm of Co, 100 ppm of Si, 300 ppm of Ca and 500 ppm of Ta. The experimental results under these conditions are as shown in FIG. 5.

Figure 5:
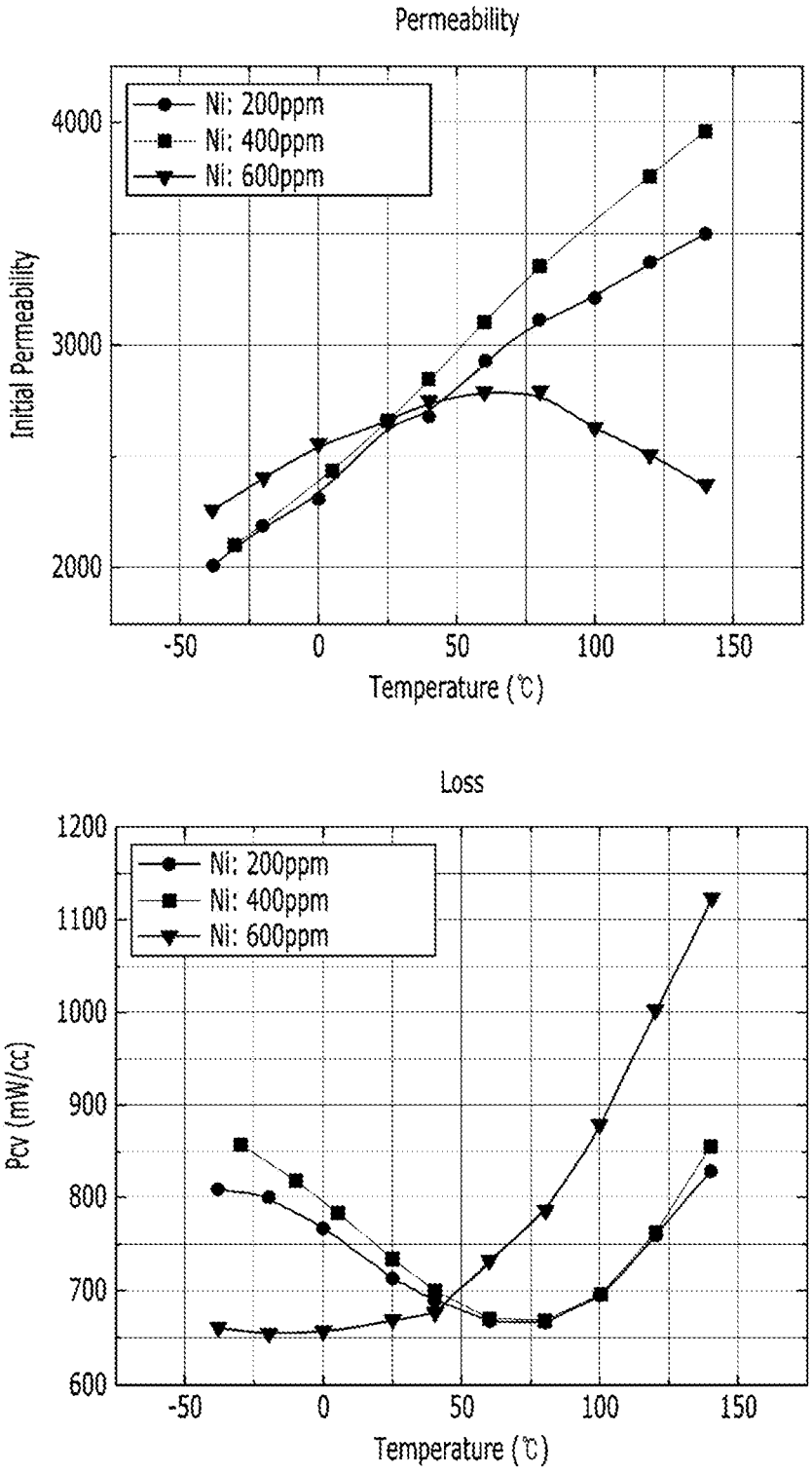
FIG. 5 shows an example of a change in permeability and loss depending on the nickel content of the magnetic core according to the embodiment.

Referring to FIG. 5, similar results for each of permeability and loss were obtained when Ni was 200 ppm and when Ni was 400 ppm. However, when Ni was 600 ppm, there was a difference of a shape change of the graph in terms of loss as well as permeability. This may mean that 600 ppm of Ni is excessive. Therefore, the optimal content of Ni is less than 600 ppm, but the disclosure is not necessarily limited thereto.

Next, the experimental conditions related to the content of Co are as follows.

The content of Co was changed to each of 500 ppm and 1500 ppm, and in both cases, Co was mixed together with 200 ppm of Ni through the post-addition process described above, the sintering process was the same, the main composition included Fe 69.75 wt %, Mn 22.94 wt % and Zn 6.97 wt %, and the additive contents were fixed at 100 ppm of Si, 500 ppm of Ca, 500 ppm of Ta, 100 ppm of Zr, and 100 ppm of V. The experimental results under these conditions are as shown in FIG. 6.

Figure 6:
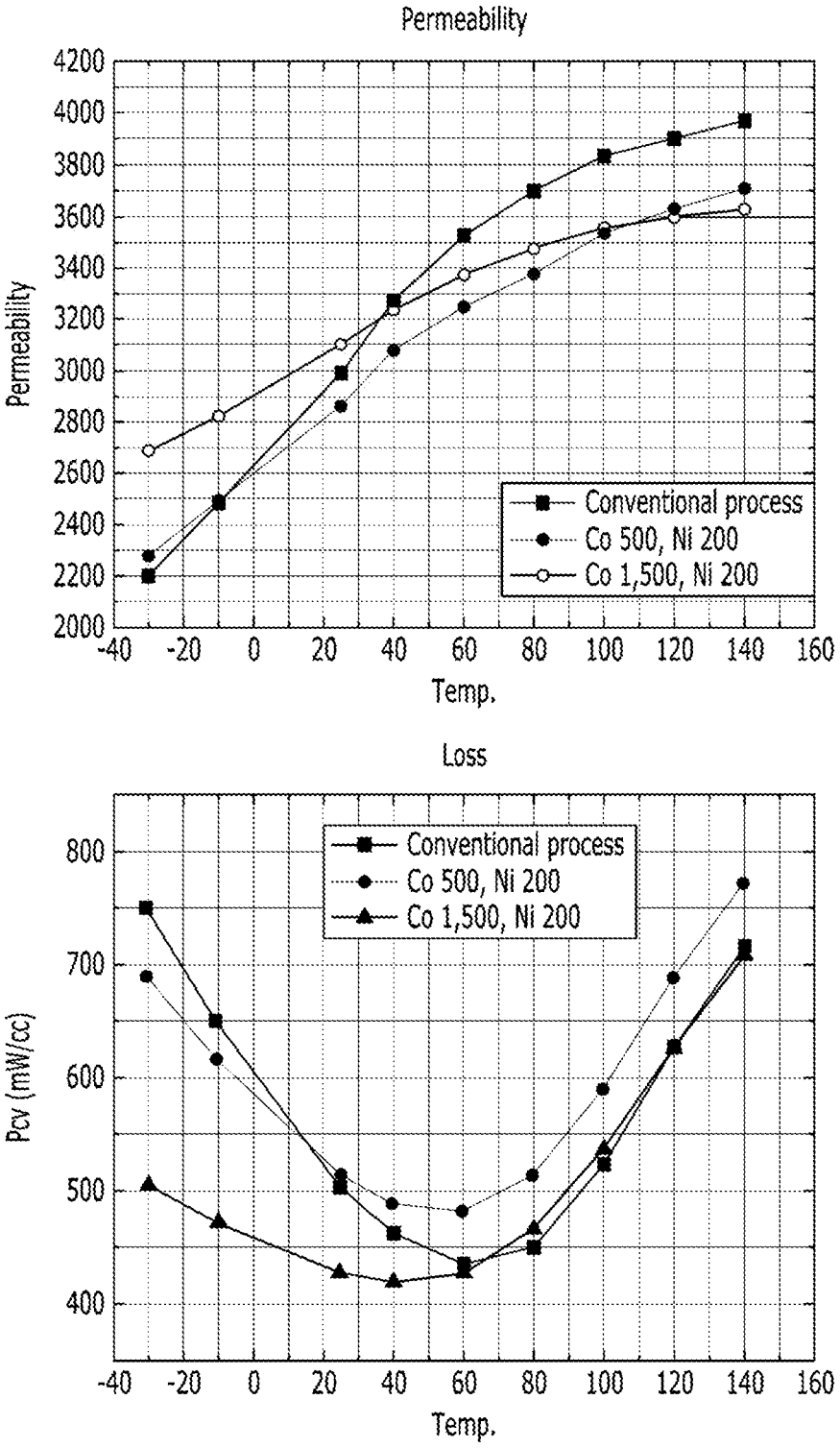
FIG. 6 shows an example of a change in the permeability and loss depending on the cobalt content of the magnetic core according to the embodiment.

FIG. 6 shows an example of changes in permeability and loss depending on the cobalt content of the magnetic core according to the embodiment.

As can be seen from FIG. 6, when the content of Co was 1500 ppm, permeability and loss characteristics were better than when the content of Co was 500 ppm. However, as can be seen from FIG. 6, when the content of Co was 500 ppm, there is a section that exhibits worse performance than the conventional process rather than the post-addition process. Therefore, the optimal content of Co is greater than 500 ppm, but the disclosure is not necessarily limited thereto.

In order to determine the optimum content of the components according to the present embodiment, the contents of some main components were fixed and the contents of other main components and non-magnetic additives were varied, the characteristics were measured under conditions of 100 kHz and 200 mT, and the results are shown in Table 7.

TABLE 7

| Main composition (wt %) | Content (ppm) | | | | | | | Characteristics | |
|---|---|---|---|---|---|---|---|---|---|
| | CoO | NiO | $Ta_2O_5$ | CaO | $SiO_2$ | $ZrO_2$ | $V_2O_5$ | Permeability (25° C.) | Loss (100° C.) |
| Mn 22.94 | — | — | — | — | — | — | — | 1,042 | 2,483 |
| Zn 6.97 | 1,000 | 200 | 500 | 500 | 100 | — | — | 2,684 | 1,012 |
| Fe 69.75 | 2,000 | — | 500 | 500 | 100 | — | — | 2,351 | 759 |
| | 2,000 | 200 | 500 | 500 | 100 | — | — | 2,981 | 610 |
| | 2,000 | 400 | 500 | 500 | 100 | — | — | 2,900 | 502 |
| | 2,000 | 400 | 500 | 500 | 100 | 100 | 100 | 3,034 | 478 |
| | 2,500 | 400 | 500 | 500 | 100 | 100 | 100 | 2,920 | 546 |
| | 3,000 | 400 | 500 | 500 | 100 | 100 | 100 | 3,349 | 349 |
| | 3,500 | 400 | 500 | 500 | 100 | 100 | 100 | 2,993 | 416 |
| | 4,000 | 400 | 500 | 500 | 100 | 100 | 100 | 3,239 | 1,115 |
| | 4,500 | 400 | 500 | 500 | 100 | 100 | 100 | 2,993 | 801 |

In Table 7, in the main composition, the content of manganese (Mn) was 22.94 wt %, the content of zinc (Zn) was 6.97 wt % and the content of iron (Fe) was 69.75 wt %, and the content (ppm) of each of SiO, CaO, Ta2O5, ZrO2 and V2O5, excluding some additives, was also fixed. As a result of experiments performed while changing the content of CoO and NiO under these conditions, when the content of CoO was 3,000 ppm and the content of NiO was 400 ppm, permeability of 3349 and loss of 349 were obtained. These contents correspond to 0.3 wt % of CoO and 0.004 wt % of NiO on a weight-ratio basis, and both the highest permeability and the lowest loss were obtained compared to other cases, and it can be seen that there is a critical significance in the corresponding content ratio.

Hereinafter, the performance of the magnetic core manufactured according to the process of FIG. 2 under the conditions of Table 7, in which the CoO content is 3,000 ppm and the NiO content is 400 ppm, will be described. The performance of the magnetic core described below will be based on the result of experimentation according to AEC-Q200 among vehicle reliability items, assuming that the magnetic core is to be applied to vehicle parts. AEC-Q200 is a reliability test standard applied to passive devices, set forth by the Automotive Electronics Council (AEC).

Specifically, the test was conducted on items such as thermal shock, impact resistance, vibration and strength.

Figure 7:
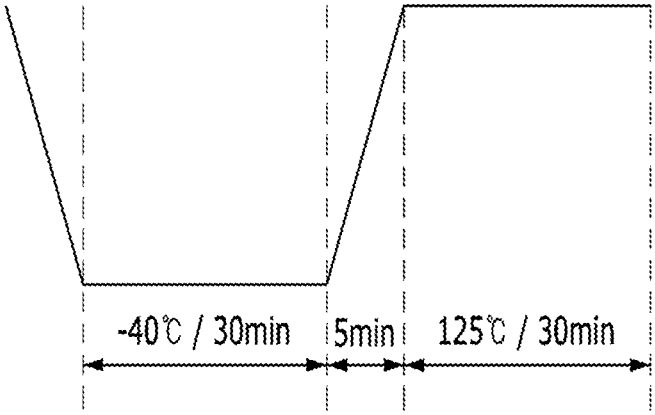
FIG. 7 shows an example of a temperature change applied to a thermal shock test of a magnetic core according to an embodiment.

First, the thermal shock test was conducted for 1,000 cycles of 30 minutes each at −40/+125° C., corresponding to Grade 1 of AEC-Q200. The temperature change applied in this test is as shown in FIG. 7. As shown in FIG. 7, one cycle includes temperature change was conducted linearly for 5 minutes.

The test results are shown in Table 8 below.

TABLE 8

| | | Sample | | | | | |
|---|---|---|---|---|---|---|---|
| Item | Spec. | 1 | 2 | 3 | 4 | 5 | 6 |
| Permeability | — | 3209 | 3248 | 3233 | 3209 | 3306 | 3250 |
| (25° C.) | | 2995 | 3024 | 3022 | 3008 | 3068 | 3054 |
| Core Loss | — | 348 | 355 | 360 | 362 | 339 | 352 |
| (100° C.) | | 357 | 365 | 364 | 358 | 359 | 376 |
| ∇permeability | ≤±15% | 6.7% | 6.9% | 6.5% | 6.3% | 7.2% | 6.0% |
| ΔCore Loss | ≤±15% | 2.5% | 2.9% | 1.1% | 0.9% | 5.9% | 6.7% |

| | | Sample | | | | Stability | |
|---|---|---|---|---|---|---|---|
| Item | Spec. | 7 | 8 | 9 | 10 | Min | Max |
| Permeability | — | 3231 | 3192 | 3191 | 3217 | 3209 | 3305.5 |
| (25° C.) | | 3030 | 3032 | 3017 | 2953 | 2994.9 | 3068.2 |
| Core Loss | — | 360 | 350 | 363 | 351 | 339.13 | 361.61 |
| (100° C.) | | 372 | 344 | 366 | 370 | 356.66 | 376.01 |
| ∇permeability | ≤±15% | 6.2% | 5.0% | 5.4% | 8.2% | 5.0% | 8.2% |
| ΔCore Loss | ≤±15% | 3.5% | 1.6% | 0.8% | 5.4% | 0.8% | 6.7% |

As shown in Table 8, the test results showed that the permeability decrease was 5.0 to 8.2% and the core loss (@ 100° C.) increase was 0.8 to 6.7%, without cracks or breakage, thus satisfying AEC-Q200 pass conditions (i.e., within ±15%).

Next, an impact resistance test was performed at an impact acceleration of 100G or less with regard to an impact waveform of a semi-sinusoidal wave, a total of 18 times 3 times in each of the +/−directions of each of x, y, and z axes for a time of 6 ms. The test results are shown in Table 9 below.

TABLE 9

| | | Sample | | | | | | Stability | |
|---|---|---|---|---|---|---|---|---|---|
| Item | Spec. | 1 | 2 | 3 | 4 | 5 | 6 | Min | Max |
| Permeability | — | 3,205 | 3,144 | 3,276 | 3,269 | 3,253 | 3,243 | 3144 | 3276 |
| (25° C.) | | 3,078 | 3,071 | 3,150 | 3,171 | 3,107 | 3,103 | 3071 | 3171 |
| Core Loss | — | 348 | 340 | 340 | 345 | 362 | 345 | 340 | 362 |
| (100° C.) | | 340 | 348 | 343 | 345 | 363 | 348 | 340 | 363 |
| ∇Permeability | ≤±15% | 4.0% | 2.3% | 3.8% | 3.0% | 4.5% | 4.3% | 2.3% | 4.5% |
| ΔCore Loss | ≤±15% | 2.3% | 2.4% | 0.9% | 0.0% | 0.3% | 0.9% | 0.0% | 2.4% |

As shown in Table 9, the test results showed that the permeability decrease was 2.3 to 4.5% and the core loss (@ 100° C.) increase was up to 2.4% without cracking or breakage, thus satisfying the AEC-Q200 Pass conditions.

Next, a vibration test was conducted under conditions including a vibration frequency of 10 ↔2000 Hz, a vibration acceleration of 5G, a sweep time of 20 minutes/sweep, a test time of 4 hours for each of x, y, and z axes, and a total time of 12 hours. The test results are shown in Table 10 below.

TABLE 10

| | | Sample | | | | | | | Stability | |
|---|---|---|---|---|---|---|---|---|---|---|
| Item | Spec. | 1 | 2 | 3 | 4 | 5 | 6 | 7 | Min | Max |
| Permeability | — | 3,238 | 3,192 | 3,234 | 3,337 | 3,264 | 3,203 | 3,301 | 3192 | 3337 |
| (25° C.) | | 3,326 | 3,157 | 3,149 | 3,283 | 3,206 | 3,172 | 3,235 | 3149 | 3326 |
| Core loss | — | 326 | 347 | 340 | 333 | 336 | 347 | 338 | 326 | 347 |
| (100° C.) | | 323 | 348 | 341 | 334 | 337 | 348 | 339 | 323 | 348 |
| VPermeability | ≤±15% | 2.7% | 1.1% | 2.6% | 1.6% | 1.8% | 1.0% | 2.0% | 1.0% | 2.7% |
| ΔCore loss | ≤±15% | 0.9% | 0.3% | 0.3% | 0.3% | 0.3% | 0.3% | 0.3% | 0.3% | 0.9% |

As shown in Table 10, the test results showed that the permeability decrease was 1.0 to 2.7% and the core loss (@ 100° C.) increase was up to 0.9% without cracking or breakage, thus satisfying the AEC-Q200 Pass conditions.

Meanwhile, a strength test was conducted by applying a load vertically downward along a height direction of the toroidal core using a UTM LS1 device capable of applying a maximum load of 1 kN (i.e., direction: compression). At this time, the applied speed was 30 mm/min and the applied limit load was 1,000 N. In addition, the specifications of the magnetic core used in the test are shown in Table 11 below.

TABLE 11

| | Size (mm) | | | Magnetic Dimensions | | | |
|---|---|---|---|---|---|---|---|
| Type | Outer diameter | Inner diameter | Height | Le (mm) | Ae ($mm^2$) | Ve ($mm^3$) | Number |
| Toroidal | 25 | 15 | 8 | 62.8 | 40.0 | 2,513 | 5 |

The results of strength test for the core under the conditions shown in Table 11 are shown in Table 12 below.

TABLE 12

| No. of cycles | 1 | 2 | 3 | 4 | 5 | Ave. |
|---|---|---|---|---|---|---|
| Measured value (N) | 890 | 670 | 770 | 960 | 830 | 824 |

Figure 8:
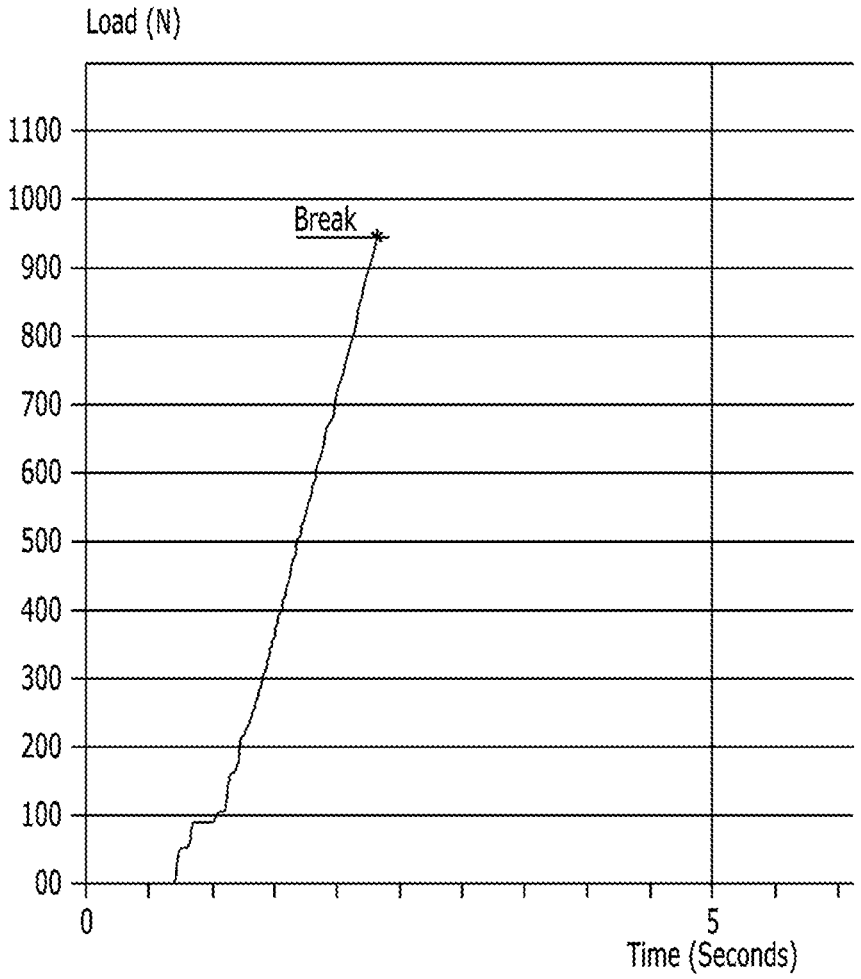
FIG. 8 shows an exemplary result of a strength test of the magnetic core according to an embodiment.

Referring to Table 12, in a total of 5 tests, the load causing breakage was within the range from 670 to 960 N, and the mean thereof was 824 N. Among these results, raw data of the results of the fourth test are shown in FIG. 8.

The excellent performance of the magnetic core according to the embodiments described so far, that is, excellent performance in items such as thermal shock, impact resistance, vibration and strength, is caused by the distribution of the components of the grain boundary resulting from post-addition of components, unlike the raw materials. This will be described with reference to FIGS. 9A to 9C.

Figure 9A:
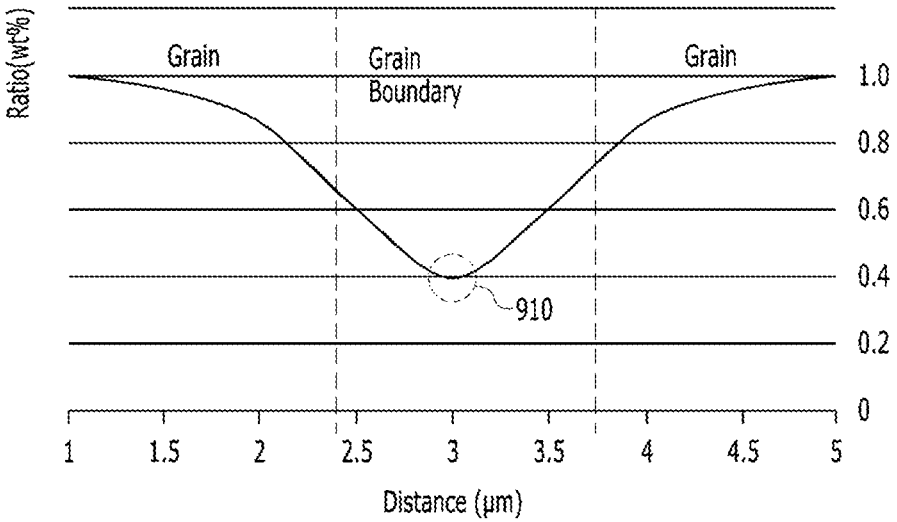
FIG. 9A shows the distribution of cobalt and nickel components of the magnetic core according to an embodiment.
Figure 9B:
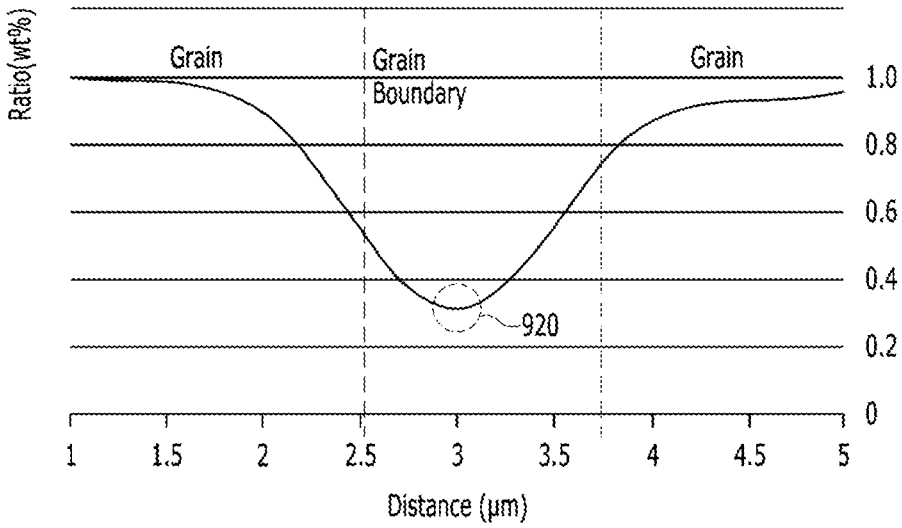
FIG. 9B shows the distribution of cobalt and nickel components of the magnetic core according to a comparative embodiment.
Figure 9C:
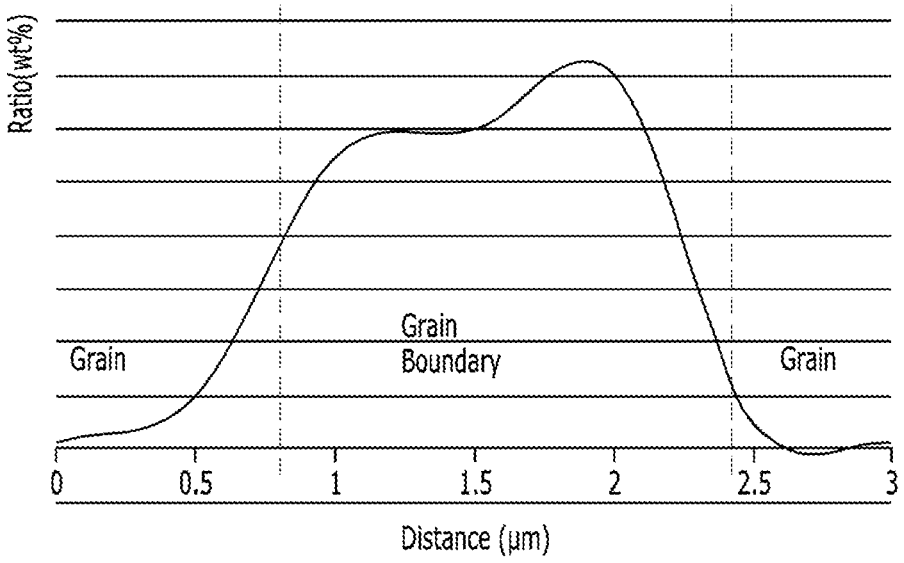
FIG. 9C shows the distribution of other components of the non-magnetic additive according to an embodiment.

FIG. 9A shows the distribution of cobalt and nickel components of the magnetic core according to an embodiment, FIG. 9B shows the distribution of cobalt and nickel components of the magnetic core according to a comparative embodiment and FIG. 9C shows the distribution of other components of the non-magnetic additive according to an embodiment.

Respective graphs in FIGS. 9A to 9C show the distribution of each composition material in grains and grain boundaries adjacent thereto using on scanning electron microscopy (SEM) and energy dispersive X-ray spectroscopy (EDS). In addition, in the comparative embodiment, the composition ratio of the components is the same as that of the magnetic core according to one embodiment, but the magnetic core is produced by adding all the components together upon initial mixing, without post-addition.

First, referring to FIGS. 9A and 9B, in the magnetic core according to the embodiment, cobalt and nickel are present in the grain boundary in an amount of 40% or more (i.e., 0.4 wt %) of the maximum distribution (i.e., 1 wt %) of the grain region, meaning that the content ratio of Co and Ni in the grain boundary to the grain is 0.4 or more. However, in the magnetic core according to the comparative embodiment, it can be seen that the content of cobalt and nickel in the grain boundary decreased to 0.3 wt %. More specifically, when comparing the lowest content point (910) of the magnetic additive in the grain boundary according to the embodiment, with the lowest content point 920 of the magnetic additive in the grain boundary according to the comparative embodiment, about 0.04 wt % to 0.08 wt %, that is, about 4% to about 8% of the magnetic additive (Co, Ni) is more distributed in the lowest content point (910) of the magnetic additive in the grain boundary according to the embodiment.

In conclusion, in the magnetic core according to the embodiment, even at the grain boundary, a considerable amount of cobalt and nickel, corresponding to 0.4 wt % or more, is distributed, so that excellent thermal shock and low-temperature characteristics can be obtained. Meanwhile, as shown in FIG. 9C, nonmagnetic additives, that is, components such as Si, Ca, Ta, Zr and V, are mainly present in the grain boundary. Specifically, the content of the non-magnetic additive in the grain region gradually increases in the direction in which the distance increases from 0 (i.e., in an adjacent grain direction). If the size of the area corresponding to the content of the non-magnetic additive in the corresponding region is assumed to be 1, the size of the area corresponding to the content of the non-magnetic additive of the grain boundary is 9 to 10. Therefore, the ratio of a total content of the non-magnetic additives in at least one grain, to a total content of the non-magnetic additives in the grain boundary located between the grain and another grain adjacent thereto in a specific direction is 0.1 or more. The content of these main components and additives can be measured using WDXRF (Wavelength Dispersive X-ray Fluorescence) equipment.

The description of each of the embodiments may be applied to the other embodiments, as long as the contents do not conflict with each other.

As is apparent from the above description, the magnetic core according to the embodiment has an improved composition ratio at grain boundaries, thus exhibiting excellent low-temperature characteristics and thermal shock characteristics.

The effects that can be accomplished herein are not limited to those described above, and other effects not described herein will be obvious to those skilled in the art from the description given above.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A magnetic core comprising:

37 to 44 mol % of manganese (Mn) oxide;

9 to 16 mol % of zinc (Zn) oxide;

42 to 52 mol % of iron (Fe) oxide;

a magnetic additive; and a non-magnetic additive, wherein the magnetic additive comprises cobalt (Co) oxide and nickel (Ni) oxide, wherein the nickel oxide is present in an amount of 0.2 mol % to 0.4 mol %, and wherein the magnetic core has a permeability of 2,900 or more at 25° C. and a core loss of 500 mW/cm$^3$ or less at 100° C. under conditions of 100 kHz and 200 mT.

2. The magnetic core according to claim 1, wherein the magnetic core has a permeability decrease of 5.0 to 8.2% and a core loss increase of 0.8 to 6.7% at −40 to 125° C. during 1,000 cycles for 30 minutes in each cycle.

3. The magnetic core according to claim 1, wherein the magnetic core has a permeability decrease of 2 to 5% and a core loss increase of 0.05 to 3.00% under an impact caused by an impact acceleration of a semi-sinusoidal wave of 100G in each of ±directions in x, y, and z axes for a time of 6 ms.

4. The magnetic core according to claim 1, wherein the magnetic core has a permeability decrease of 1 to 2.7% and a core loss increase of 0.3 to 0.9% after vibration is maintained for 4 hours in each of x, y and z axes at a vibration frequency of 10⇔2000 Hz, a vibration acceleration of 5G for a sweep time of 20 minutes.

5. The magnetic core according to claim 1, wherein the magnetic core has a toroidal shape, and the magnetic core has an average breaking load of 800 N or more after applying a load 5 times at a speed of 30 mm/min under a limit load of 1,000 N vertically downwards along a height direction of the toroidal shape.

6. The magnetic core according to claim 1, wherein the cobalt (Co) oxide is present in an amount of 0.1 to 1 mol %.

7. The magnetic core according to claim 1, wherein the non-magnetic additive comprises at least one of silicon (Si) oxide, calcium (Ca) oxide, tantalum (Ta) oxide, vanadium (V) oxide or zirconium (Zr) oxide.

8. The magnetic core according to claim 7, wherein the silicon oxide is present in an amount of 50 to 200 ppm, the calcium oxide is present in an amount of 200 to 700 ppm, the tantalum oxide is present in an amount of 200 to 900 ppm, the vanadium oxide is present in an amount of 50 to 500 ppm, and the zirconium oxide is present in an amount of 50 to 500 ppm.

9. A magnetic core comprising a magnetic compound containing 37 to 44 mol % of manganese (Mn) oxide, 9 to 16 mol % of zinc (Zn) oxide, 42 to 52 mol % of iron (Fe) oxide, 0.1 to 1 mol % of cobalt (Co) oxide, 0.2 to 0.4 mol % of nickel (Ni) oxide and an additive, wherein the magnetic compound comprises a plurality of grains and a grain boundary between the corresponding grains, wherein the plurality of grains comprise a first grain and a second grain adjacent thereto, a content of the cobalt oxide gradually decreases from a center of the first grain to the second grain.

10. The magnetic core according to claim 9, wherein a ratio of a content of the cobalt oxide at a center of a first grain boundary, located between the first grain and the second grain adjacent thereto, to a content of the cobalt oxide at the center of the first grain is 0.4 or more.

11. The magnetic core according to claim 9, wherein a content of the nickel oxide gradually decreases from the center of the first grain to the second grain.

12. The magnetic core according to claim 9, wherein a ratio of a content of the nickel oxide at the center of the first grain boundary, located between the first grain and the second grain, to a content of the nickel oxide at the center of the first grain is 0.4 or more.

13. The magnetic core according to claim 9, wherein the additive comprises at least four of silicon (Si) oxide, calcium (Ca) oxide, tantalum (Ta) oxide, vanadium (V) oxide, niobium (Nb) oxide, or zirconium (Zr) oxide.

14. The magnetic core according to claim 13, wherein the silicon oxide is present in an amount of 50 to 200 ppm, the calcium oxide is present in an amount of 200 to 700 ppm, the tantalum oxide is present in an amount of 200 to 900 ppm, the vanadium oxide is present in an amount of 50 to 500 ppm, and the zirconium oxide is present in an amount of 50 to 500 ppm.

15. A magnetic core comprising a magnetic compound containing 37 to 44 mol % of manganese (Mn) oxide, 9 to 16 mol % of zinc (Zn) oxide, 42 to 52 mol % of iron (Fe) oxide and a non-magnetic additive, wherein the non-magnetic additive comprises:

50 to 200 ppm of silicon oxide ($SiO_2$);

200 to 700 ppm of calcium oxide (CaO);

200 to 900 ppm of tantalum pentoxide ($Ta_2O_5$);

50 to 500 ppm of zirconium dioxide ($ZrO_2$); and 50 to 500 ppm of vanadium pentoxide ($V_2O_5$), wherein the magnetic compound comprises a plurality of grains and a grain boundary between the corresponding grains, wherein a content of at least one of the non-magnetic additive gradually increases in a first direction from a center of a first grain among the grains to a second grain adjacent to the first grain, wherein a ratio of a total content of at least one of the non-magnetic additive in the first grain to a total content of at least one of the non-magnetic additive in the first grain boundary between the first grain and the second grain is 1:9 to 1:10.

16. The magnetic core according to claim 15, further comprising:

a magnetic additive of at least one of cobalt (Co) oxide or nickel (Ni) oxide.

17. A magnetic core comprising a compound containing 37 to 44 mol % of manganese (Mn) oxide, 9 to 16 mol % of zinc (Zn) oxide, 42 to 52 mol % of iron (Fe) oxide, and 0.2 to 0.4 mol % of nickel (Ni) oxide, and an additive, wherein the additive comprises one element in Group 2, one element in Group 4, two elements in Group 5 and one element in Group 14 of the periodic table, wherein the magnetic core has a permeability of 2,900 or more at 25° C. and a core loss of 500 $mW/cm^3$ or less at 100° C. under conditions of 100 kHz and 200 mT.

18. The magnetic core according to claim 17, wherein the additive comprises:

50 to 200 ppm of silicon oxide ($SiO_2$);

200 to 700 ppm of calcium oxide (CaO);

200 to 900 ppm of tantalum pentoxide ($Ta_2O_5$);

50 to 500 ppm of zirconium dioxide ($ZrO_2$); and 50 to 500 ppm of vanadium pentoxide ($V_2O_5$).

19. The magnetic core according to claim 17, further comprising:

0.1 to 1 mol % of cobalt (Co) oxide.

* * * * *